United States Patent [19]

Lunde

[11] Patent Number: 4,878,090

[45] Date of Patent: Oct. 31, 1989

[54] VACUUM REMOVAL OF LIQUID TONER FROM A RECORD MEMBER

[75] Inventor: George G. Lunde, St. Paul, Minn.

[73] Assignee: Minnesota Mining and Manufacturing Company, St. Paul, Minn.

[21] Appl. No.: 235,948

[22] Filed: Aug. 23, 1988

[51] Int. Cl.[4] ..... G03G 15/10

[52] U.S. Cl. ..... 355/256; 355/307; 118/652

[58] Field of Search ..... 355/10, 15, 256–258, 355/307; 118/647–652, 659–662; 430/117–119, 125; 354/318

[56] References Cited

U.S. PATENT DOCUMENTS

| | | | |
|---|---|---|---|
| 3,367,791 | 7/1966 | Lein | 430/119 |
| 3,561,400 | 2/1968 | Smitzer | 118/652 |
| 3,741,643 | 6/1973 | Smith et al. | 355/10 |
| 4,648,704 | 3/1987 | O'Leary | 118/661 X |
| 4,733,273 | 3/1988 | Lloyd | 355/10 |

*Primary Examiner*—Arthur T. Grimley
*Assistant Examiner*—J. Pendegrass
*Attorney, Agent, or Firm*—Donald M. Sell; Walter N. Kirn; David W. Anderson

[57] ABSTRACT

A development apparatus in association with an electrostatic record member is provided with a shroud surrounding a development electrode and a toner return including a vacuum source to increase circulation of the toner. The vacuum source also draws air around the shroud to strike the record member and remove excess toner.

5 Claims, 3 Drawing Sheets

VACUUM REMOVAL OF LIQUID TONER FROM A RECORD MEMBER

FIELD OF THE INVENTION

This invention relates to liquid developing apparatus used to deposit electroscopic toner particles dispersed in a fluid onto one surface of a moving recording member in accordance with a latent electrostatic image formed thereon.

BACKGROUND OF THE INVENTION

Several techniques are known for applying electroscopic toner to latent electrostatic image bearing record members so that toner will adhere to the record member in desired areas to develop the image. One technique is by cascading the particulate toner in dry form onto the surface of the record member, and removing the excess toner either by allowing it to slide off the record member by the force of gravity, or by blowing the excess toner with a fan. Another technique is to entrain the toner particles in a finely divided magnetic powder and to use a magnetic brush for distributing the toner over the surface of the record member. A third technique for distributing the toner is to entrain the toner in a dielectric liquid which is then brought in contact with the surface bearing the latent image. The developer apparatus of the present invention utilizes the latter technique.

A significant problem encountered in developer apparatus that uses liquid entrained toner is commonly known as "boundary layer depletion." This may occur even after a very short period of use, since the concentration liquid is brought of toner in the liquid near where the into contact with the recording member may lower very rapidly when developing a "dark area" of the latent image.

Other than the total immersion of the recording member in the liquid entrained toner for the purpose of development, which is not very effective with flat record members, there has existed the problem of supplying an adequate concentration of toner to ensure complete development. One of the earliest attempts to solve this problem was to use a roller dipped into a liquid toner bath. The roller, which was also conducting, was then rotated to provide a constant changing and replenishing action to the liquid entrained toner at the processing nip. Such an apparatus is illustrated in U.S. Pat. No. 3,367,791.

As processing speeds increased, equipment modifications were required to keep pace with the increased through-put. It was found that as the recording member was passed over a rotating developing electrode, the developing zone was relatively small and that effective development was limited by the volume of liquid dispersed toner that the rotating electrode could deliver to the processing nip.

U.S. Pat. No. 3,561,400 relates to an improved apparatus that attempted to solve many of the problems mentioned above. Generally, the apparatus comprises a shroud that surrounds a cylindrical roller. The shroud has an opening therein which permits a portion of the roller to project beyond the shroud. A pump provides a supply of liquid entrained toner into the space between the roller and the shroud. The roller is rotated to carry a film of the developer liquid over the projecting portion of the roller to contact the record bearing members.

An attempt to increase the through-put of such an apparatus would necessitate a drastic increase in the diameter of the rotating electrode to obtain a proper development zone as well as an adequate electrical field in the development zone.

While providing adequate toner to the image is one problem, the removal of excess toner from the image area after toning is another. Excess toner clings to the record member, and unless reliably removed, produces an undesirably dark background to the image.

SUMMARY OF THE INVENTION

The objects of the present invention are to improve development through-put by increasing the circulation of liquid toner through the development zone while providing for the removal of excess toner to prevent or reduce background effects on the image surface.

These objects are accomplished by providing a development electrode and a shroud surrounding the development electrode which has a blade adjacent the space between the development electrode and the record surface. The shroud is provided with means for removing liquid toner from the development zone including a vacuum source for rapidly removing toner from the development zone and thus increasing toner circulation and drawing air around the blade to strike the record member and strip excess toner from the record member.

BRIEF DESCRIPTION OF THE DRAWINGS

The present invention will be more thoroughly described with reference to the drawings, wherein like numbers refer to like parts in the several views, and wherein.

DETAILED DESCRIPTION OF THE INVENTION

Figure 1:
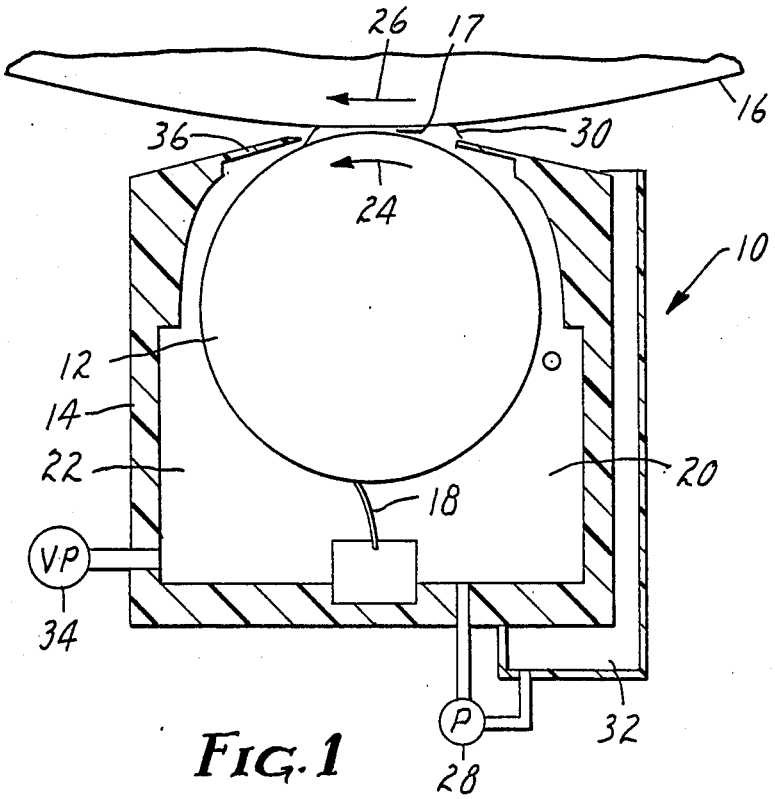
FIG. 1 is a schematic, cross-sectional view of a development apparatus according to the present invention and a portion of a cylindrical recording member.
Figure 2:
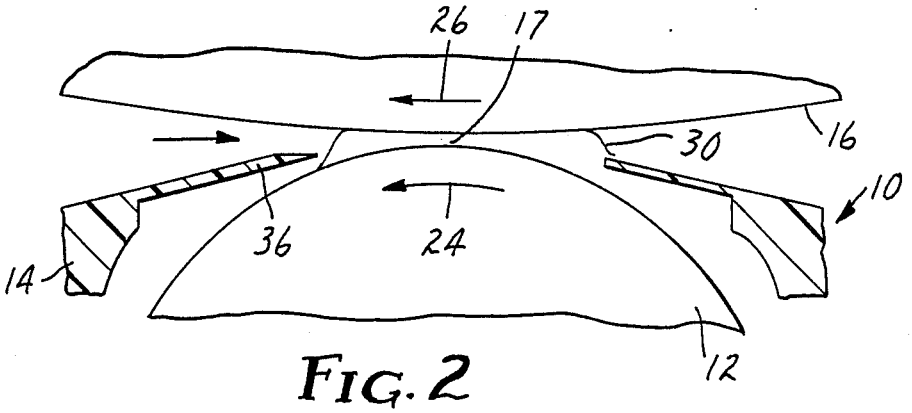
FIG. 2 is an enlarged, partial cross-sectional view of a portion of the development apparatus and recording member of FIG. 1.

FIGS. 1 and 2 illustrate a first embodiment of a development apparatus, generally indicated as 10, which includes a development roller 12 surrounded by a shroud 14 which is closed at its ends to completely enclose the roller 12. The development apparatus is located adjacent an electrostatic record bearing member 16 which is illustrated as being in cylindrical form, although the record member 16 may be in the form of a plate or web. The shroud 14 is open at the top in order to expose the development roller 12 and allow the development roller to approach the record member 16 in spaced, operative proximity, usually on the order of 0.38 mm, to form a development gap.

The shroud surrounding the development roller 12 is longitudinally divided by a wiper blade 18 into a supply chamber 20 and a return chamber 22. The development roller 12 and the record member 16 rotate in the directions of arrows 24 and 26 such that their surfaces both move from the supply chamber 20 toward the return chamber 22. Liquid toner is supplied to the supply chamber 20 by means of a pump 28 and forced toward the development gap 17. The supply of liquid toner forms a meniscus 30, the width of which defines a development zone. Liquid toner in the development zone overflows the shroud 14 to fall into a catch tray 32 for return to the supply chamber 20. Toner is also withdrawn from the development zone by a vacuum pump 34 which enhances the circulation of liquid toner through the development zone. Toner withdrawn by the vacuum pump 34 is returned to the supply pump 28 for further circulation. The vacuum produced by the vacuum pump 34 also produces a flow of air into the return chamber from outside the shroud 14.

The downstream side of the shroud 14 with respect to the rotation of the development roller 12 and the record member 16 is provided with a blade 36 which projects into the development zone. The blade 36 is positioned so as to cause the above mentioned flow of air from outside the shroud 14 to strike the record member 16 adjacent the development zone and strip excess liquid toner from the surface of the record member 16.

The liquid toner consists of pigmented, insoluble particles having diameters up to two microns, that are stabilized in ISOPAR G (Registered Trademark of Humble Oil & Refining Company), a nonpolar, branched, liquid hydrocarbon. The particles are positively charged and are attracted to areas of the record member 16 which, as a result of charging and exposure of the record member 16, are more electrically negative than the particles.

Toned density is dependent upon three factors, toner contact time, the concentration of the toner in its carrier and uniformity of the electrical field existing between the development roller 12 and the record member 16. Images developed using lower concentration toners have a cleaner background in the toned image. In addition, lower concentration toners are capable of developing small image detail with greater density and sharper edges. Thus, the developed images have high resolutions and better contrast when lower concentration toners are used.

In order to use lower concentration toners, however, the supply of liquid toner to the development zone must be increased to avoid depletion of toner particles below an acceptable level in the development zone. The provision of the vacuum source 34 on the return side of the shroud 14 has been found to greatly increase the circulation of liquid toner through the development zone and thus ensure an adequate supply of toner particles to the image.

Toner contact time is a function of the width of the development zone between the development roller 12, or more generally, development electrode 12, and the record surface 16. Uniformity of the electrical field may be enhanced by conforming the electrode 12 to the shape of the record surface 16. Both toner contact time and uniformity of the electrical field are materially improved through the use of a second embodiment of a developer apparatus 38 shown in FIGS. 3 and 4.

In this embodiment, the development electrode is in the form of an endless belt 40 tensioned between two rollers 42 and 44, either or both of which may be driven to continually move the belt past the record surface 16. As an alternative, another roller (not shown) could be used to drive the belt 40. It is desirable to drive the belt 40 so that any accumulated toner deposits on the belt 40 can be removed by a wiper blade 45 as the belt 40 moves past.

The belt 40 is conductive, and preferably stainless steel, and is supported adjacent the record member 16 by a base 46 having a flat upper surface 48. Like the developer apparatus shown in FIGS. 1 and 2, the development belt 40 is surrounded by a shroud 50 which includes a toner supply passageway 52, an overflow passageway 54 and a return passageway 56 which includes a source of vacuum. A development zone is formed between the overflow and the return passageways, 54 and 56, respectively.

That portion of the shroud 50 adjacent the return passageway is formed with a sharp tip 58 to produce a shape similar to the blade 36 of FIGS. 1 and 2 which directs air drawn to the return passageway 56 against the record member 16 to strip excess toner from the record member 16 and reduce background toning of the image area.

It will be seen that the flat shape of the development belt 40 in the area of the record member 16 greatly increases the width and uniformity of the development zone compared to the development zone produced by the point-to-point configuration produced by the proximity of the two cylindrical shapes illustrated by FIGS. 1 and 2. This increased width and uniformity of the development zone both contribute to toned density and quality as described above.

Figure 4:
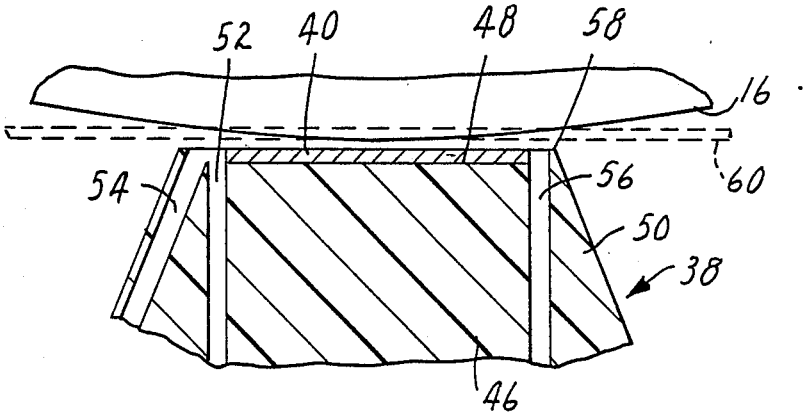
FIG. 4 is an enlarged, partial cross-sectional view of the apparatus of FIG. 3 taken generally along the line 4—4 of FIG. 3.

While the belt 40 configuration of the development electrode produces advantages over the cylindrical configuration of FIGS. 1 and 2 when used in conjunction with a cylindrical record member 16, these advantages are increased when the belt configuration is utilized in conjunction with a record member 60 in the shape of a flat plate or web, as shown in phantom lines in FIG. 4. Thus the embodiment of FIGS. 4 and 5 is most usefully employed when the development electrode is in the form of a plate or web.

Figure 5:
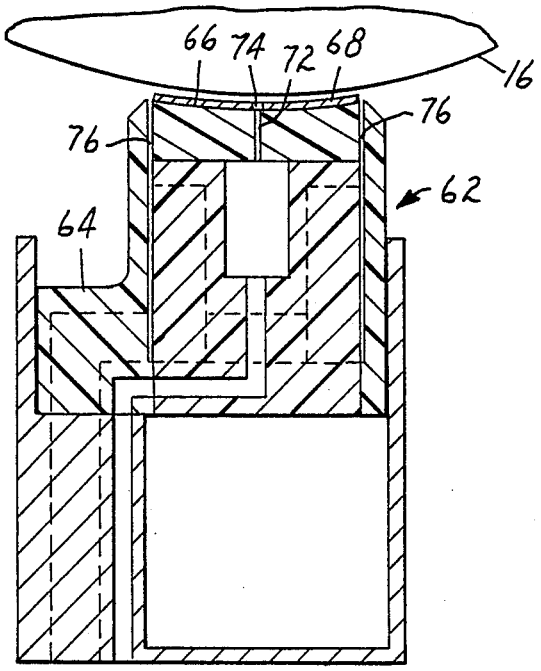
FIG. 5 is a schematic, cross-sectional view of a third embodiment of a development apparatus according to the present invention and a portion of a cylindrical record member.
Figure 6:
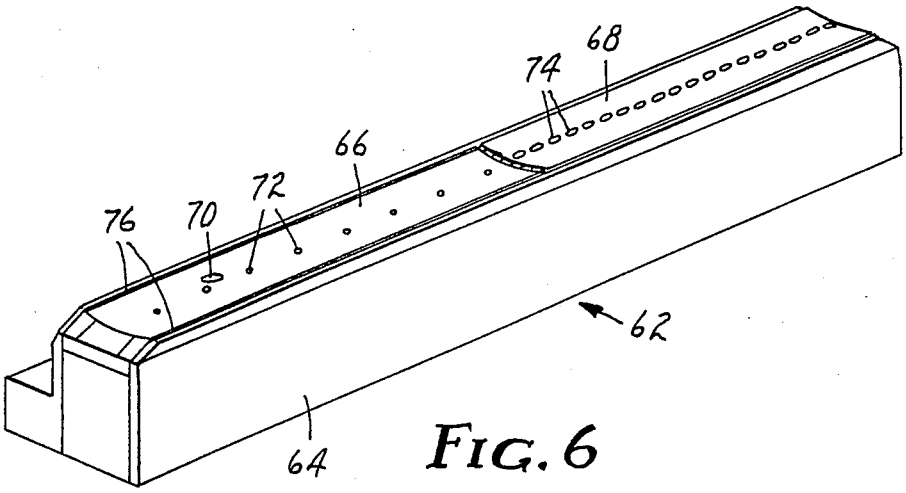
FIG. 6 is perspective view of a portion of the development apparatus of FIG. 5.

FIGS. 5 and 6 illustrate an embodiment of the present invention which incorporates the advantages of the belt development electrode but in a design which is specifically tailored for use with a record member in the form of a cylinder. The development apparatus 62 includes a base 64 which has an upper surface 66 formed to present a cylindrical concavity to the cylindrical record member 16. Thus the upper surface of the base 64 of the development apparatus 62 matches the curvature of the record member 16. Tensioned upon the base upper surface 66 is a belt 68 which is magnetically attractive and preferable is steel. It is necessary that the belt 68 be magnetically attractive so that the belt may be drawn to the concave shape of the upper surface 66 of the base 64 by magnets 70 located within the base 64. These magnets 70 are preferably located on both sides of the centerline of the concave upper surface 66 of the base 64, although they could be positioned along the centerline. Only one magnet is illustrated in FIG. 6, but it should be recognized that another is located symmetrically with respect to the centerline; on the opposite side of the centerline to the one shown in FIG. 6 and an equal distance from the opposite end of the base 64. Any convenient number of magnets 70 may be utilized, but the minimum number consistent with forcing the belt 68 to conform to the base 64 is desirable to keep friction between the belt 68 and the base 64 at a minimum.

Figure 3:
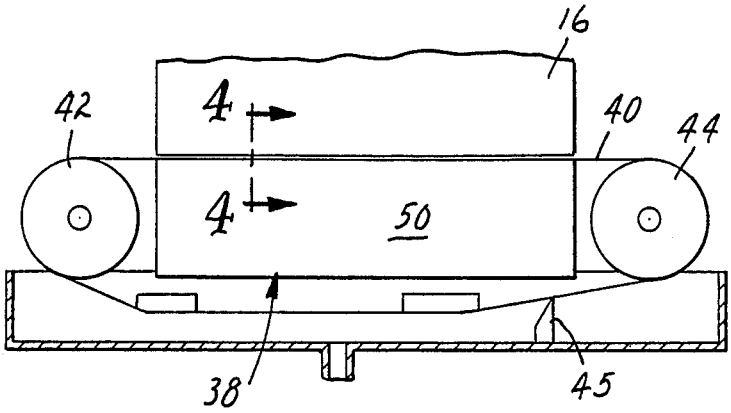
FIG. 3 is a schematic, elevational view of a second embodiment of a development apparatus according to the present invention, with a portion in cross-section.

The development apparatus of FIGS. 5 and 6 is slightly different from that shown in FIGS. 3 and 4 in that toner is supplied through the base 64 by means of a series of holes 72 spaced along the centerline of the base 64. Slots 74 are provided in the belt 68 to allow the liquid toner to flow into the development zone between the belt 68 and the record member 16. Toner is extracted from the development zone by means of return passageways 76 located on either side of the belt 68. The return passageways are provided with a source of vacuum as previously described. Like the previous embodiments, the development apparatus is provided with a shaped shroud which causes air rushing to the vacuum source to strike the record member and strip excess toner therefrom in order to reduce background toning of the image area.

The development apparatus embodied in FIGS. 5 and 6 thus provides the advantages of a particularly wide and uniform development zone, namely increased contact time between the toner and the record member and a uniform electrical field, while retaining the advantages produced by the provision of a vacuum return, namely increased toner circulation and the elimination or reduction of excess toner on the record member.

We claim:

1. A development apparatus for the application of liquid toner to the surface of an electrographic record bearing member, comprising:

a development electrode in spaced, operative liquid toner applying proximity to said record bearing member;

a shroud surrounding said developing electrode and including a blade extending into said space between said development electrode and said record bearing member;

means for providing a continuous supply of said liquid toner and forcing said liquid toner into said space between said development electrode and said record member;

means associated with said shroud for removing said liquid toner from said space including a source of vacuum for drawing air around said blade in addition to removing said liquid toner from said space, wherein;

said blade is positioned with respect to said record member so as to cause said air drawn around said blade to strike said record member and remove excess liquid toner from the surface of said record member.

2. A development apparatus according to claim 1 wherein said development electrode is a cylindrical roller.

3. A development apparatus according to claim 2 wherein said record member is a cylinder having an axis parallel to that of said development electrode.

4. A development apparatus according to claim 3 further including deposit removal means for said development electrode.

5. A development apparatus according to claim 4 wherein said deposit removal means is a wiper blade in contact with said development electrode.

* * * * *

UNITED STATES PATENT AND TRADEMARK OFFICE

CERTIFICATE OF CORRECTION

PATENT NO. : 4,878,090

DATED : October 31, 1989

INVENTOR(S) : George G. Lunde and Gregory L. Zwadlo

It is certified that error appears in the above-identified patent and that said Letters Patent is hereby corrected as shown below:

Cover Page: Add Inventor: Gregory L. Zwadlo

Column 1, lines 33-39, the second sentence of this paragraph should read --This may occur even after a very short period of use, since the concentration of toner in the liquid near where the liquid is brought into contact with the recording member may lower very rapidly when developing a "dark area" of the latent image.--.

Signed and Sealed this

Thirteenth Day of November, 1990

*Attest:*

HARRY F. MANBECK, JR.

*Attesting Officer*

*Commissioner of Patents and Trademarks*